US008286685B2

(12) United States Patent
Hsieh

(10) Patent No.: US 8,286,685 B2
(45) Date of Patent: Oct. 16, 2012

(54) LIMIT MECHANISM OF UPPER STOP LEVEL AND LOWER STOP LEVEL FOR ROLLING DOOR

(76) Inventor: Chung-Hsien Hsieh, Taipei Hsien (TW)

( * ) Notice: Subject to any disclaimer, the term of this patent is extended or adjusted under 35 U.S.C. 154(b) by 181 days.

(21) Appl. No.: 12/923,235

(22) Filed: Sep. 10, 2010

(65) Prior Publication Data

US 2012/0061035 A1 Mar. 15, 2012

(51) Int. Cl.
*E06B 9/56* (2006.01)

(52) U.S. Cl. ..... 160/307; 160/293.1; 160/193

(58) Field of Classification Search ..... 160/133, 160/188, 193, 293.1, 307, 321; 192/141
See application file for complete search history.

(56) References Cited

U.S. PATENT DOCUMENTS

| | | | | |
|---|---|---|---|---|
| 2,504,018 | A * | 4/1950 | Gibson et al. | 192/48.1 |
| 2,620,911 | A * | 12/1952 | Krell | 192/141 |
| 4,266,437 | A * | 5/1981 | Obergfell | 74/89.37 |
| 6,761,080 | B2 * | 7/2004 | Lange et al. | 74/89.37 |
| 7,355,363 | B2 * | 4/2008 | Angiuli et al. | 318/466 |
| 7,564,202 | B2 | 7/2009 | Hsieh | |

* cited by examiner

*Primary Examiner* — Blair M. Johnson
(74) *Attorney, Agent, or Firm* — Bacon & Thomas, PLLC

(57) ABSTRACT

A limit mechanism for door machine for controlling the door curtain in such a manner that it stops accurately at an upper stop level and a lower stop level, the door machine including an output pulley driving a reel of the door curtain. The limit mechanism comprises: a screw rod both ends of which are rotatably supported on a frame, the end portion of one end of the screw rod being provided with a driven pulley which interlinks with the reel of the door curtain; a pair of nut blocks each having a threaded hole centrally arranged for joining with the screw rod so as to slide thereon; a pair of lock devices for locking relative positions between the pair of nut blocks; and a pair of buffer devices arranged respectively at both ends of the screw rod for limiting the sliding stroke of the nut blocks.

3 Claims, 5 Drawing Sheets

LIMIT MECHANISM OF UPPER STOP LEVEL AND LOWER STOP LEVEL FOR ROLLING DOOR

BACKGROUND OF THE INVENTION

1. Field of the Invention

This invention relates to a limit mechanism, more particularly to a limit mechanism for a manually operated door machine, which is utilized to control a door curtain in such a manner that the door curtain stops accurately at an upper stop level or a lower stop level.

2. Brief Description of Prior Art

In a conventional manually operated rolling door machine, there are a pair of L-shaped blocking plates arranged back to back attached to the end portion of the door curtain wound by the reel, which is utilized to block the door curtain from exceeding the upper stop level in the ascending stroke and the lower stop level in the descending stroke. In the operation of the conventional manually operated rolling door machine, a user generally will stop exerting force by visual estimation as soon as the door curtain arrive near the upper stop level or the lower stop level with the result that this operation is not reliable. Incautiously, the user will make a lot of noise in operating the door curtain due to impact as the blocking plates collide with a stop means at the upper stop level or the lower stop level, even subjecting the door curtain to an impact and causing the squeezing deformation of the door curtain. Hence, there is still room for further improvement in implementation as well as in structure of the door machine.

SUMMARY OF INVENTION

The main object of the present invention is to provide a limit mechanism for a manually operated door machine, which can avoid an excessive force exertion on a door curtain so that the door curtain can be effectively prevented from violent impact and squeezing deformation when the door curtain surpass the upper stop level or the lower stop level.

In order to achieve the above and other objects, a limit mechanism for the manually operated door machine according to the present invention is provided, which is utilized to control the door curtain in such a manner that it can stop accurately at an upper stop level and a lower stop level. The door machine includes an output pulley which interlinks with a reel of the door curtain. The limit mechanism comprises: a screw rod, both ends of which are rotatably supported on a frame and one end portion of the screw rod being provided with a driven pulley which interlinks with the reel of the door curtain; a pair of nut blocks each having a threaded hole at the center for joining with the screw rod; a pair of lock devices for locking the pair of nut blocks; a guiding cassette fixed on the frame for transforming the rotation of the pair of nut blocks into linear motion in the axial directions of the screw rod when the nut blocks the screw rod is rotated by the reel; and a pair of buffer devices each arranged near both ends of the screw rod for moderating the sliding stroke of the nut block.

According to the present invention, the central axis of the screw rod of the limit mechanism is arranged parallel to the central axis of the reel. The door machine drives the reel and the screw rod of the limit mechanism simultaneously. The distance between the pair of nut blocks is adjusted to correspond to the distance between the upper stop level and the lower stop level in a predetermined ratio. Each buffer device includes a locating ring attached to the outer end portion of the screw rod. And a thrust bearing, buffer washers and a plurality of spring washers are inserted in succession toward the inward direction of the screw rod so that each of the buffer devices will render a buffering resistance against the nut block arriving at the terminating point of the sliding stroke.

According to the present invention, when a driving mechanism is operated to start the door curtain by pulling a chain to rotate a chain disk, the user only pulls the chain until he pulls the chain by exerting more and more strength to rotate the chain disk, then the user knows that the door curtain is approaching to at the required level. Even if an excessive force is exerted, it can be absorbed by the buffer devices. Therefore, the door curtain can be accurately constrained to stop at the upper stop level in the ascending stroke and at the lower stop level in the descending stroke such that the door curtain can be prevented from impact and squeezing deformation when they surpass the upper stop level or the lower stop level by an excessive force exertion.

BRIEF DESCRIPTION OF ACCOMPANYING DRAWINGS

DETAILED DESCRIPTION OF PREFERRED EMBODIMENTS

The technical contents of the present invention will become more apparent from the detailed description of the preferred embodiments in conjunction with the accompanying drawings. It is noted that the preferred embodiments are not intended to restrict the implementation range of the present invention.

Figure 1:
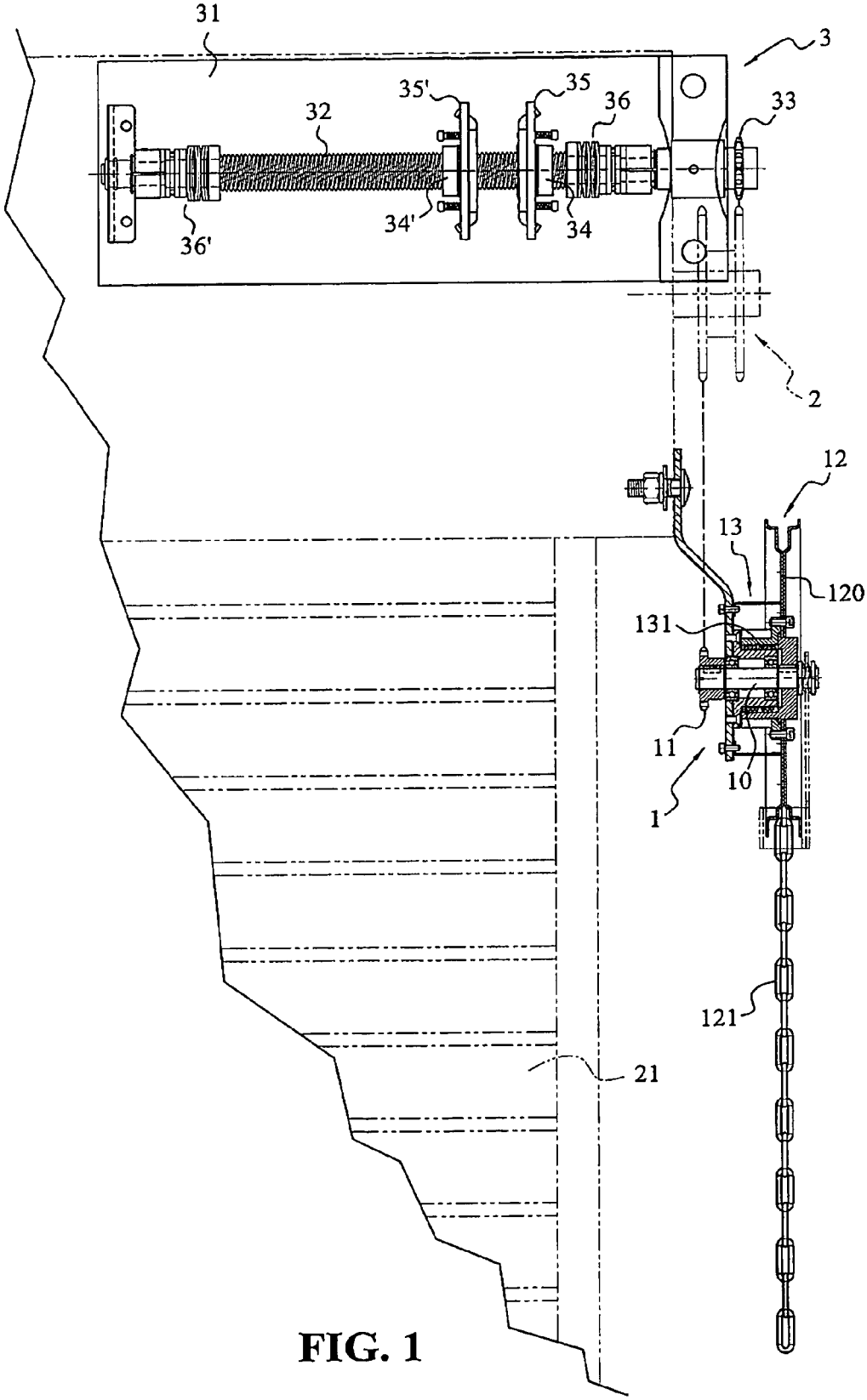
FIG. 1 is a front schematic view showing the embodiment in which the limit mechanism of the present invention in cooperation with a door machine is applied in a rolling door device.
Figure 2:
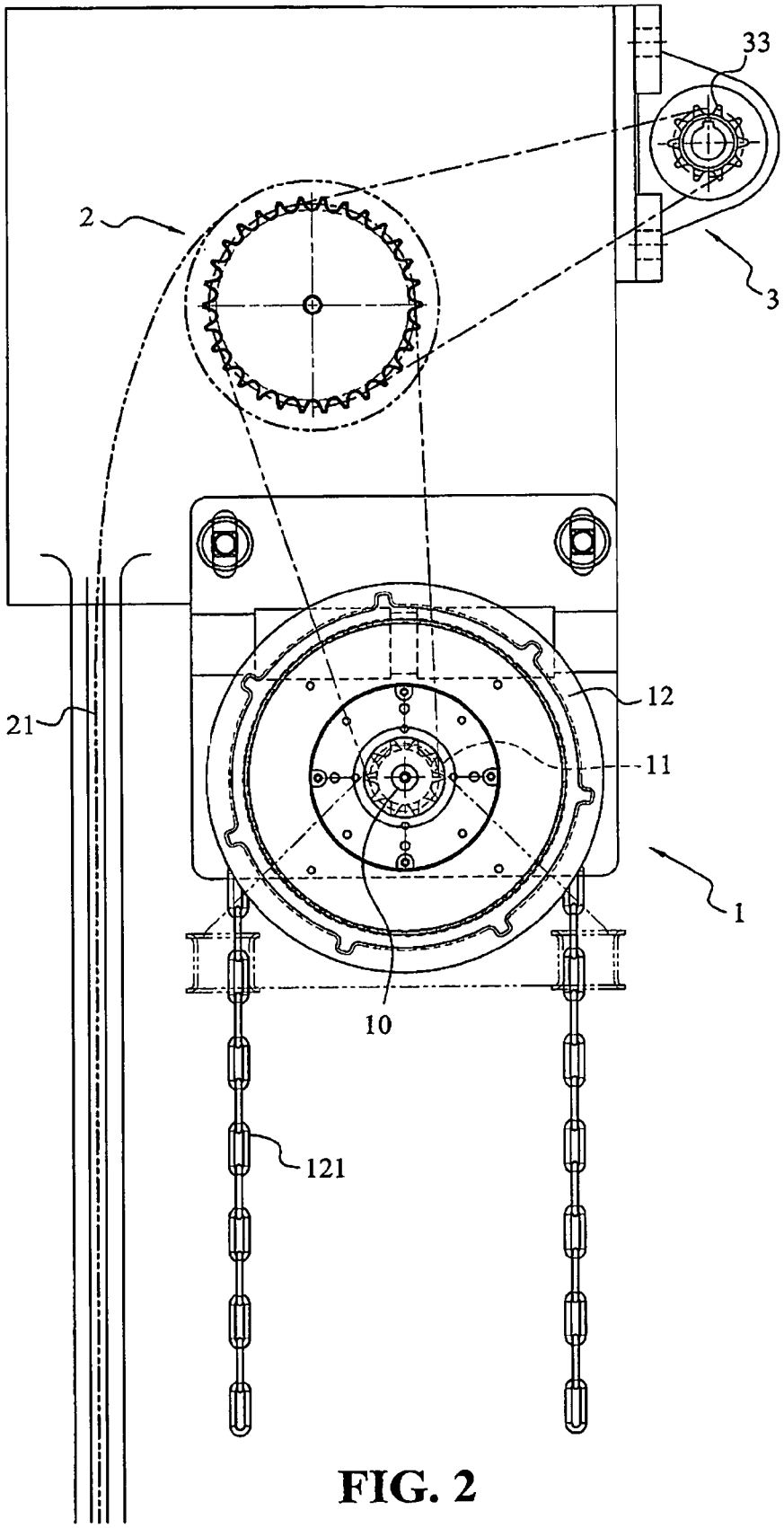
FIG. 2 is a side schematic view showing the embodiment of FIG. 1.

Firstly, referring to FIGS. 1 and 2, a limit mechanism 3 according to the present invention in cooperation with a manually operated door machine 1 is implemented in a rolling door machine. The limit mechanism 3 is utilized to limit the door curtain 21 of the rolling door machine to stop at the upper stop level in an ascending stroke or at the lower stop level in a descending stroke. The door curtain 21 is composed of a plurality of slats. The door machine 1 basically comprises a central shaft 10 one end of which is attached with an output pulley 11 to interlink with a reel 2 for winding the door curtain 21. A brake mechanism 13 is arranged around the circumference of the central shaft 10 between both ends thereof, the brake mechanism 13 including a pair of torsion springs 131 the inner diameter of which shrinks or enlarges so as to control the central shaft 10 in a brake-actuation state or a brake-release state. A drive mechanism 12 including a chain disk 120 and a chain 121 encircling thereof is disposed on the other end of the central shaft 10. When an external force exerts on the drive mechanism 12, the torsion springs 131 are actuated to enlarge their inner diameter so as to rotate the central shaft 10. When external force is not applied to the drive mechanism 12, the weight of the door curtain 21 constantly acts on the output pulley 11 of the door machine 1, and further actuates the torsion springs 131 to reduce the inner diameter thereof so as to maintain the brake-actuation state. Inasmuch as this invention does not involve with this improvement, further description thereof is thus omitted.

Figure 3:
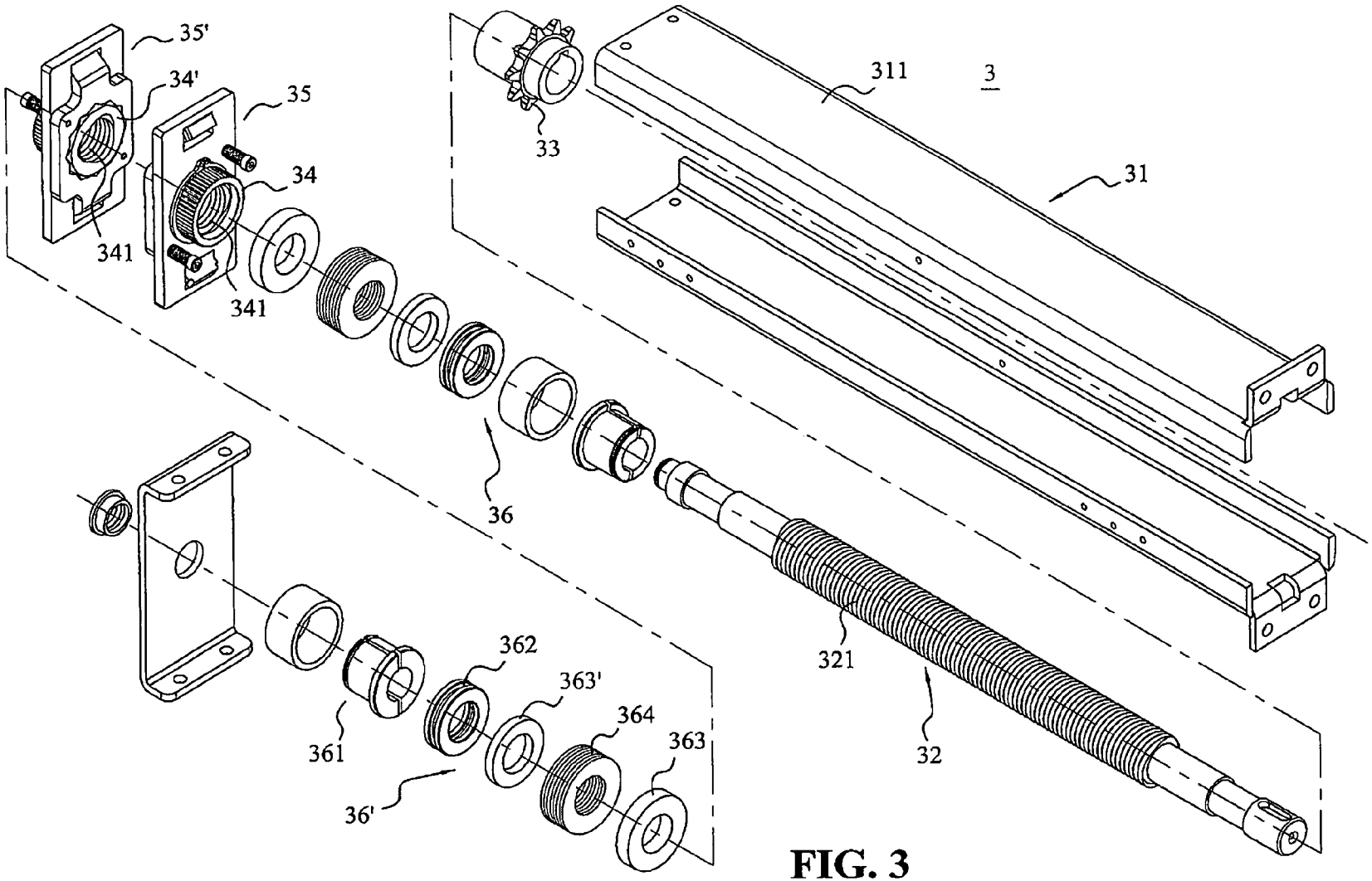
FIG. 3 is an exploded perspective view showing the limit mechanism of the present invention.
Figure 4:
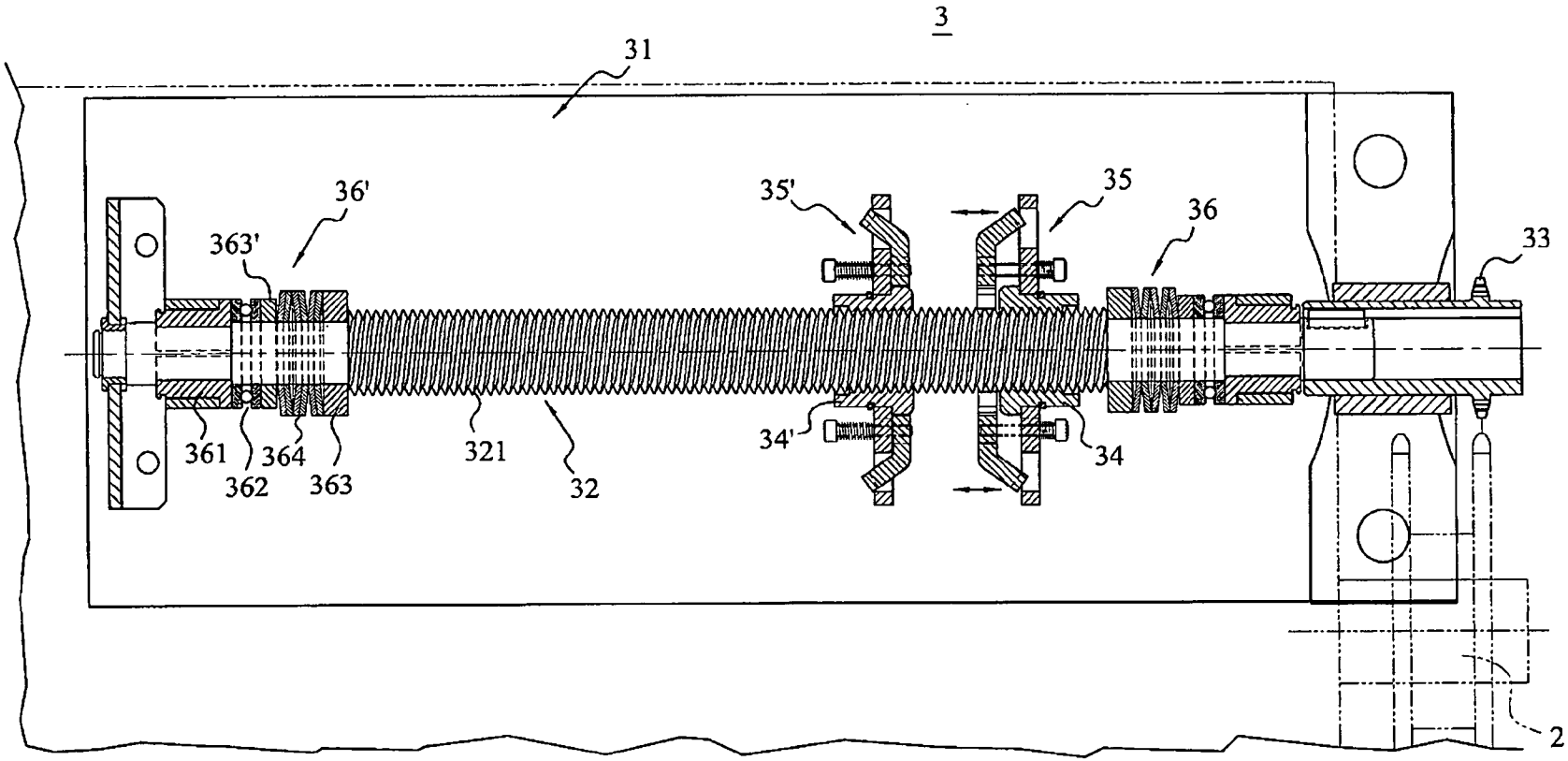
FIG. 4 is a sectional view showing the limit mechanism of the present invention in an assembled state.
Figure 5:
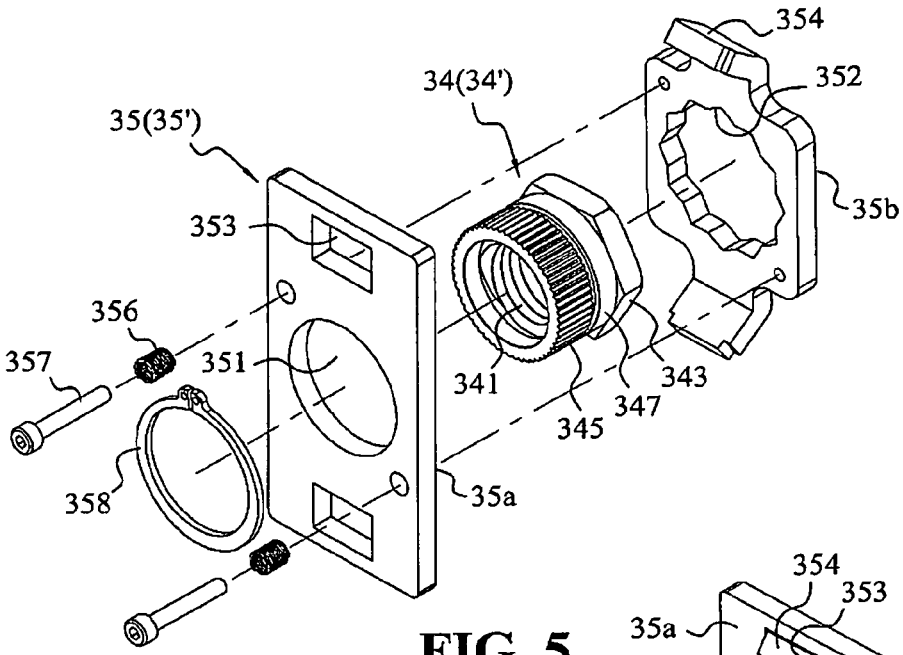
FIG. 5 is an exploded perspective view showing the nut block and the lock device of the present invention.

According to the present invention, as shown in FIGS. 3, 4 and 5, the limit mechanism 3 comprises: a screw rod 32 with threads on its outer surface and both ends of the screw rod 32 are pivotally disposed on a frame 31, one end portion of the screw rod 32 being attached with a driven pulley 33 which is rotated by the reel 2 of the door curtain; a pair of nut blocks 34, 34' including a first nut block 34 and a second nut block 34', either having a through threaded hole for joining with the screw rod 32; a pair of lock devices 35, 35' each for locking the first nut block 34 and the second nut block 34'; a guiding cassette 311 fixed on the frame 31 for transforming the rotation of the pair of nut blocks 34, 34' into linear motion in the axial direction of the screw rod 32 when the screw rod 32 is rotated; and a pair of buffer devices 36, 36' arranged respectively near both ends of the screw rod 32 for moderating the sliding stroke of the nut blocks 34, 34', i.e., corresponding to the upper stop level in an ascending stroke or the lower stop level in a descending stroke of the door curtain 21.

According to the present invention, the central axis of the screw rod 32 of the limit mechanism 3 is arranged to be parallel with the central axis of the reel 2 of the door curtain 21. The door machine 1 drives the reel 2 and the screw rod 32 of the limit switch mechanism 3 simultaneously.

Figure 6:
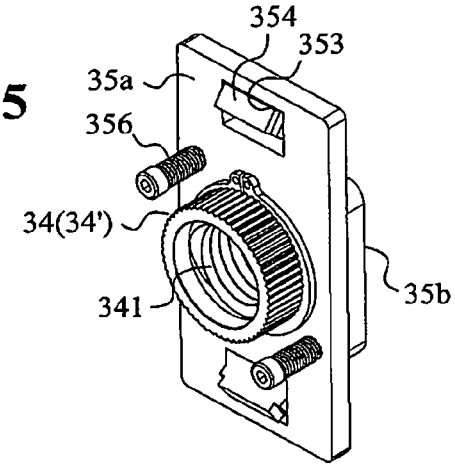
FIG. 6 is a perspective view showing the nut block and the lock device of the present invention in an assembled state.
Figure 7:
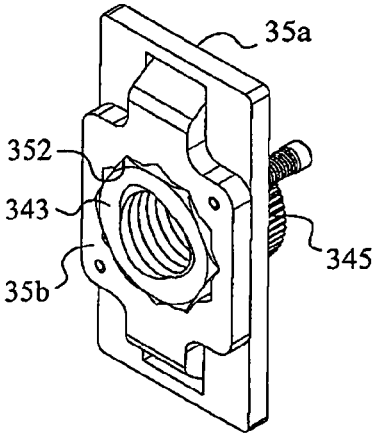
FIG. 7 is a perspective view from another direction showing the nut block and the lock device of the present invention in FIG. 6.

A polygon-flanged cap portion 343 is provided on one end of each nut block 34, 34', and a knurl portion 345 is formed on the circumferential surface on the other end of each nut block 34, 34'. Each of the lock device 35, 35' includes a stationary member 35*a* and a movable member 35*b*, the stationary member 35*a* being a rectangular plate with a central hole 351 and a pair of lock grooves 353 each formed on an upper portion and a lower portion from the central hole 351. The movable member 35*b* has a polygonal accommodation bore 352 at the center thereof for accommodating the cap portion 343, and a pair of protruding lugs 354 each corresponding in shape to the lock grooves 353 and extending outward are respectively formed on the upper side and the lower side of the accommodation bore 352. Furthermore, a pair of bolts 357 are provided, each being biased by an elastic element 356 at one end, and the other end penetrating through the stationary member 35*a* and anchored on the diagonally opposite positions of the movable member 35*b*. The movable member 35*b* is biased by the elastic element 356 such that the protruded lugs 354 are constantly inserted toward the lock grooves 353. Each of the nut blocks 34, 34' is formed with a shoulder 347 between the cap portion 343 and the knurl portion 345, which is abutted against the surface of the stationary member 35*a* by the elastic element 356 and then is fixed by a retainer 358 when the knurl portion 345 is inserted within the central hole 351 of the stationary member 35*a*, the cap portion 343 is correspondingly received within the accommodation bore 352 of the movable member 35*b*. The edge of the cap portion 343 is constrained by the polygonal accommodation bore 352 of the movable member 35*b* in a lock position in which the cap portion 343 is unrotatable as shown in FIGS. 6 and 7.

According to the present invention, each of the buffer devices 36, 36' includes a locating ring 361 attached to the outer end portion of the screw rod 32. A thrust bearing 362, a buffer washer 363' and a plurality of spring washers 363 are inserted in succession toward the inward direction of the screw rod 32 so that the buffer devices 36, 36' will render buffering resistance against the nut blocks 34, 34' arriving at the terminating point of the sliding stroke. Further, the above guiding cassette 311 is formed by a pair of half portions having a U-shaped cross section for housing the upper and lower sides of the stationary member 35*a* respectively. The guiding cassette 311 is utilized to guide the lock devices 35, 35' and transform the rotation of the nut blocks 34, 34' into linear motion in the axial directions.

Figure 8:
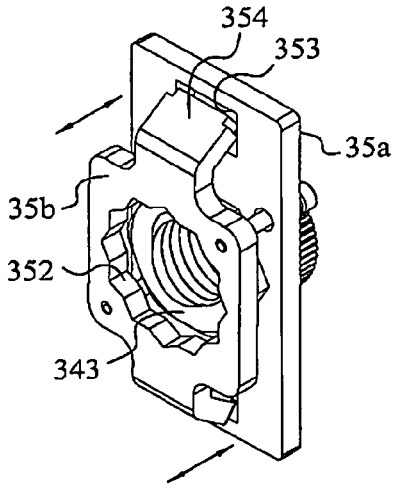
FIG. 8 is a perspective view showing the nut block and the lock device of the present invention in a locking-released state.

Referring to FIGS. 4 and 8, before the use of the limit mechanism 3 which has been installed in site, the relative position between the first nut block 34 and the second nut block 34' has to be corrected first, to correspond in ratio to the upper stop level in the ascending stroke and the lower stop level in the descending stroke of the door curtain 21. As regards correction, the locking state of the nut blocks 34, 34' locked by the lock devices 35, 35' is released first, i.e., a force is exerted on the movable member 35*b* to resist the potential energy of the elastic element 356 such that the protruding lugs 354 retreat from the lock grooves 353 of the stationary member 35*a*, and the cap portions 343 of the nut blocks 34, 34' can escape from the constraining of the accommodation bore 352 of the movable member 35*b*. At this moment, either of the nut blocks 34, 34' can be rotated on the screw rod 32 by exerting the knurl portion 345 so as to be adjusted to correspond in ratio to the upper stop level in the ascending stroke and the lower stop level in the descending stroke of the door curtain 21. After the correction is finished, the relative positions between the pair of nut blocks 34, 34' are locked by the pair of lock devices 35, 35'.

When driving mechanism is operated to start the door curtain by a user only pulling the chain 121 to rotate the chain disk 120 until the user pulls the chain by exerting more and more strength and can't pull further in the long run, the user knows that the door curtain reaches at the required level. Even if an excessive force is exerted, it can be absorbed by the buffer devices. Therefore, the door curtain can be accurately controlled to stop at the upper stop level in the ascending stroke and at the lower stop point level in the descending stroke such that the door curtain can be prevented from impact and squeezing deformation when the door curtain surpass the upper stop level or the lower stop level by an excessive force exertion.

While the preferred embodiments have been described as above, it is noted that the preferred embodiments are not intended to restrict the scope of implementation of the present invention. Modifications and variations proposed without departing from the scope of the claims of the present invention are considered to be still within the scope of the present invention.

What is claimed is:

1. A limit mechanism for a door machine for controlling a door curtain to stop accurately at an upper stop level and a lower stop level, said door machine including an output pulley and a reel actuated by the output pulley for rolling the door curtain, said limit mechanism comprising:

a screw rod arranged in parallel with the reel, both ends of which are rotatably supported on a frame, an end portion of the screw rod being provided with a driven pulley which is rotated by the reel;

a pair of nut blocks composed of a first nut block and a second nut block, each of the first and the second nut blocks having a threaded hole for joining with the screw rod;

a pair of lock devices for locking the first nut block and the second nut block;

a guiding cassette fixed on the frame for transforming a rotation of the pair of nut blocks into a linear motion in axial directions of the screw rod when the screw rod is rotated; and a pair of elastic buffer devices arranged respectively at the both ends of the screw rod for defining sliding strokes of the first and the second nut blocks;

wherein a polygon-flanged cap portion is provided on one end of each of the first and the second nut blocks, and a knurl portion is formed on a circumferential surface on the other end of each of the first and the second nut blocks; each of the lock device includes a stationary member and a movable member, the stationary member being a rectangular plate with a central hole and a pair of lock grooves each formed on an upper portion and a lower portion of the rectangular plate, the movable member being a square plate with a polygonal accommodation bore centrally arranged and a pair of protruding lugs each formed corresponding in shape to the lock grooves and extending outwardly form an upper end and a lower end of the square plate; the movable member is biased by an elastic element such that the protruding lugs are constantly inserted toward said lock grooves when the stationary member is coupled with the movable member; each of the nut block is formed with a shoulder between the cap portion and the knurl portion; and when said knurl portion is inserted through the central hole of the stationary member, the cap portion is correspondingly received within the accommodation bore of the movable member to the effect that the edge of said cap portion is constrained by said polygonal accommodation bore of said movable member and the nut blocks are prevented from turning with the screw rod.

2. The limit mechanism for the door machine as claimed in claim 1, wherein the guiding cassette is formed by a pair of half portions having a U-shaped cross section, which are oppositely disposed outside of the stationary member and is utilized to limit the nut blocks to axially slide without rotation.

3. The limit mechanism for the door machine as claimed in claim 2, wherein each elastic buffer device includes a locating ring attached to an outer end of the screw rod, and a thrust bearing, a first buffer washer, a plurality of spring washers and a second buffer washer are arranged in succession on the outer end of the screw rod in an inward direction.

* * * * *